US010407947B2

(12) United States Patent
Kimura et al.

(10) Patent No.: US 10,407,947 B2
(45) Date of Patent: Sep. 10, 2019

(54) VEHICLE DOOR LOCK DEVICE

(71) Applicant: MITSUI KINZOKU ACT CORPORATION, Kanagawa (JP)

(72) Inventors: Shuntaro Kimura, Kanagawa (JP); Daisuke Enomoto, Kanagawa (JP)

(73) Assignee: Mitsui Kinzoku Act Corporation, Kanagawa (JP)

( * ) Notice: Subject to any disclaimer, the term of this patent is extended or adjusted under 35 U.S.C. 154(b) by 265 days.

(21) Appl. No.: 15/524,111

(22) PCT Filed: May 13, 2016

(86) PCT No.: PCT/JP2016/064311

§ 371 (c)(1),
(2) Date: May 3, 2017

(87) PCT Pub. No.: WO2017/073100

PCT Pub. Date: May 4, 2017

(65) Prior Publication Data

US 2017/0335605 A1 Nov. 23, 2017

(30) Foreign Application Priority Data

Oct. 29, 2015 (JP) ..... 2015-213422

(51) Int. Cl.
*E05B 79/02* (2014.01)
*E05B 81/66* (2014.01)
(Continued)

(52) U.S. Cl.
CPC ..... *E05B 79/02* (2013.01); *E05B 81/54* (2013.01); *E05B 81/64* (2013.01); *E05B 81/66* (2013.01);
(Continued)

(58) Field of Classification Search
CPC ..... E05B 81/06; E05B 85/02; E05B 81/54; E05B 77/34; E05B 81/16; E05B 81/14;
(Continued)

(56) References Cited

U.S. PATENT DOCUMENTS 5,236,234 A * 8/1993 Norman ..... E05B 81/06 292/201
2012/0061977 A1 3/2012 Takeda
(Continued)

FOREIGN PATENT DOCUMENTS

DE 102009053384 A1 5/2011
FR 2995622 A1 3/2014
(Continued)

OTHER PUBLICATIONS

Search Report issued in corresponding International Patent Application No. PCT/JP2016/064311, dated Jun. 28, 2016.
(Continued)

*Primary Examiner* — Mark A Williams
(74) *Attorney, Agent, or Firm* — McDermott Will & Emery LLP

(57) ABSTRACT

A vehicle door lock device includes a latch mechanism holding and releasing a striker of a door; a locking/unlocking member switching between locking and unlocking of the door; a first switch detecting a state of the locking/unlocking member; a second switch switching between on and off of a room lamp of the vehicle; a connection portion to which a connector for an external device is connected; and a switch plate connecting at least the first switch and the second switch to the connection portion. Further, the switch plate includes a first switch plate connecting the first switch to the connection portion, a second switch plate connecting the second switch to the connection portion, and a switch-plate joining portion joining the first switch plate and the second
(Continued)

switch plate together and passing between a bottom surface of a case and the locking/unlocking member.

4 Claims, 8 Drawing Sheets

(51) Int. Cl.

| | |
|---|---|
| ***E05B 81/64*** | (2014.01) |
| ***E05B 81/54*** | (2014.01) |
| ***E05B 85/02*** | (2014.01) |
| ***E05B 81/72*** | (2014.01) |
| *E05B 77/34* | (2014.01) |
| *E05B 81/16* | (2014.01) |

(52) U.S. Cl.
CPC ..... *E05B 81/72* (2013.01); *E05B 85/02* (2013.01); *E05B 77/34* (2013.01); *E05B 81/16* (2013.01)

(58) Field of Classification Search
CPC ..... E05B 81/64; E05B 81/66; E05B 81/68; E05B 15/1635; Y10T 70/5898; H05K 2201/0999; Y10S 310/06
See application file for complete search history.

(56) References Cited

U.S. PATENT DOCUMENTS

| | | | | |
|---|---|---|---|---|
| 2012/0081844 | A1* | 4/2012 | Hill | B60K 37/00 361/679.01 |
| 2013/0049379 | A1* | 2/2013 | Yokota | E05B 81/20 292/129 |
| 2014/0252783 | A1* | 9/2014 | Yokota | E05B 81/20 292/196 |
| 2016/0076277 | A1 | 3/2016 | Kouzuma et al. | |
| 2017/0138096 | A1* | 5/2017 | Zhang | E05B 77/38 |
| 2017/0370130 | A1* | 12/2017 | Kimura | E05B 77/34 |
| 2018/0195318 | A1* | 7/2018 | Katagawa | E05B 81/14 |
| 2018/0291657 | A1* | 10/2018 | Strole | E05B 85/26 |

FOREIGN PATENT DOCUMENTS

| | | | |
|---|---|---|---|
| JP | 2012-041764 | A | 3/2012 |
| JP | 2012-062649 | A | 3/2012 |
| JP | 2013-049990 | A | 3/2013 |
| JP | 2013-083086 | A | 5/2013 |
| JP | 2013-142262 | A | 7/2013 |
| JP | 2014-062383 | A | 4/2014 |
| JP | 2014-214501 | A | 11/2014 |
| JP | 2016-089350 | A | 5/2016 |
| JP | 2016-098589 | A | 5/2016 |
| WO | 2011/057619 | A2 | 5/2011 |

OTHER PUBLICATIONS

Chinese Office Action issued in corresponding Chinese Patent Application No. 201680045878.4, dated Mar. 5, 2019.

* cited by examiner

VEHICLE DOOR LOCK DEVICE

CROSS REFERENCE

This application is the U.S. National Phase under 35 U.S.C. § 371 of International Application No. PCT/JP2016/064311, filed on May 13, 2016, which claims the benefit of Japanese Application No. 2015-213422, filed on Oct. 29, 2015, the entire contents of each are hereby incorporated by reference.

FIELD

The present invention relates to a vehicle door lock device.

BACKGROUND

A vehicle door lock device that can switch between a state (a locked state) in which a door is closed and locked and a state (an unlocked state) in which the door in the locked state is unlocked to be capable of being open is conventionally known. For example, Patent Literature 1 discloses a technique of a vehicle door lock device including a latch mechanism that engages with or disengages from a striker on a vehicle body when a door on the vehicle is open or closed, and a lock mechanism that is capable of switching between a locked state in which an engagement state of the latch mechanism and the striker (a state in which the door is closed) is locked, and an unlocked state in which the locked state is released.

An active lever that is capable of turning to a lock position corresponding to the locked state and an unlock position corresponding to the unlocked state according to an operation of a door lock knob, a key cylinder, a wireless key, or the like, and a motor that is a turning drive source of the active lever, and a detection switch for detecting a turning position (the lock position or the unlock position) of the active lever are provided in a housing of the vehicle door lock device described in Patent Literature 1. In the vehicle door lock device having the configuration described above, internal wires for electrically connecting external devices such as a power source (an in-vehicle power source) and an electronic control unit mounted on the vehicle to the motor and the detection switch described above are required. The internal wires are generally assembled, for example, by insert molding of a conduction plate, which is formed by punching of a sheet metal, into a resin and are provided near the motor and the detection switch in the housing.

CITATION LIST

Patent Literature

Patent Literature 1: Japanese Laid-open Patent Publication No. 2013-83086

SUMMARY

Technical Problem

In recent years, in a vehicle door lock device, there has been a need to place a plurality of electronic components such as a room lamp switch that switches between on and off of a vehicle room lamp in addition to the motor and the detection switch described above into the housing. According to this need, the number of internal wires provided in the housing of the vehicle door lock device tends to increase, resulting in an increase in the number of components required for assembly of the vehicle door lock device. This leads to an increase in the labor and cost involved with the assembly of the vehicle door lock device.

The present invention has been made in view of the above circumstances, and an object of the present invention is to provide a vehicle door lock device that enables easy assembly of internal wires required for a demanded number of electronic components and consequently can prevent an increase in the labor and cost of the assembly as much as possible.

Solution to Problem

To resolve the problem and achieve the object as described above, a vehicle door lock device according to the present invention includes: a latch mechanism that engagingly holds a striker of a vehicle when a door of the vehicle is closed and that releases the striker when the door is to be open; a locking/unlocking member that has a function related to switching between locking and unlocking of the door; a first switch that detects a state of the locking/unlocking member corresponding to switching between locking and unlocking of the door; a second switch that switches between on and off of a room lamp of the vehicle according to a turning position of a latch of the latch mechanism; a connection portion that is located on an opposite side of the latch mechanism across the locking/unlocking member and to which a connector for connecting an external device is to be connected; and a switch plate that electrically connects at least the first switch and the second switch to the connection portion. Further, the switch plate includes a first switch plate that is located on an opposite side of the latch mechanism across the locking/unlocking member and that electrically connects the first switch to the connection portion, a second switch plate that is located on an opposite side of the first switch plate across the locking/unlocking member and that electrically connects the second switch to the connection portion, and a switch-plate joining portion that joins the first switch plate and the second switch plate together and, passes between a bottom surface of a case, housing at least the locking/unlocking member and the switch plate, and the locking/unlocking member, and is interposed between the case and the locking/unlocking member.

Further, in the vehicle door lock device according to the above invention, the first switch plate includes a first-switch holding portion that holds the first switch, and the second switch plate includes a second-switch holding portion that holds the second switch.

Further, in the vehicle door lock device according to the above invention, the locking/unlocking member includes a key member that performs an action related to switching between locking and unlocking of the door according to a lock/unlock operation with a key, and the switch-plate joining portion passes between the bottom surface of the case and the key member and is interposed between the case and the key member.

Advantageous Effects of Invention

In the vehicle door lock device according to the present invention, it is easy to assemble internal wires required for a demanded number of electronic components, and consequently an effect is obtained where it is possible to prevent an increase in the labor and cost of the assembly as much as possible.

DESCRIPTION OF EMBODIMENTS

Figure 1:
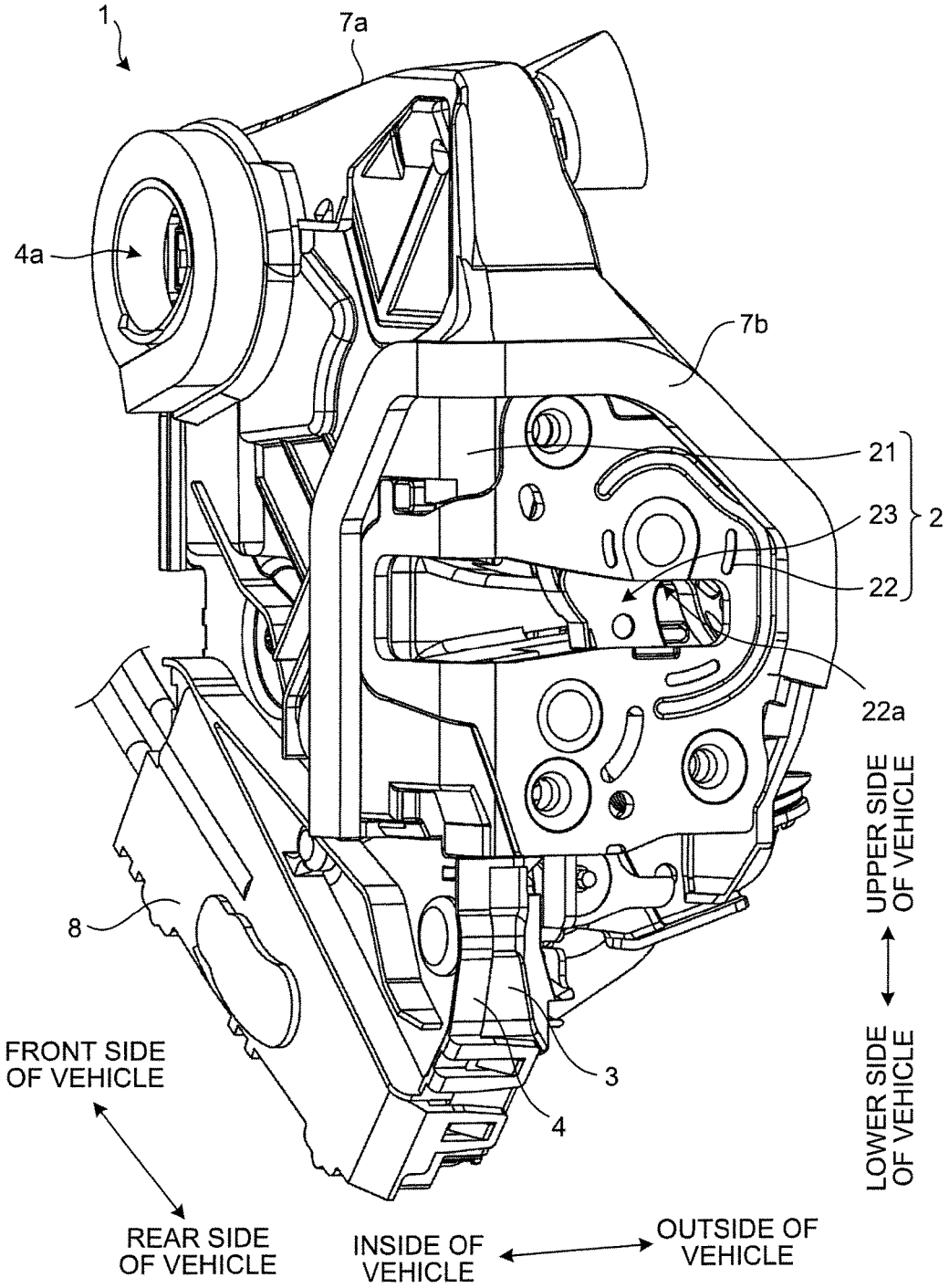
FIG. 1 is a perspective view illustrating an external appearance of a vehicle door lock device according to an embodiment of the present invention.

Exemplarily embodiments of a vehicle door lock device according to the present invention will be described below in detail with reference to the accompanying drawings. Note that the present invention is not limited to the embodiments. These drawings are only schematic and it should be noted that the relations between respective elements, ratios between respective elements, and the like may be different from those in actual products. Also among these drawings, there may be portions where relations and ratios therebetween are mutually different. In the drawings, the same reference signs are used to describe the same components.

(Configuration of Vehicle Door Lock Device)

A configuration of a vehicle door lock device according to an embodiment of the present invention is described first. FIG. 1 is a perspective view illustrating an external appearance of the vehicle door lock device according to the embodiment of the present invention. A vehicle door lock device 1 according to the embodiment of the present invention is attached to an inner part of a door (a front side door, for example) of a vehicle and includes a door latch device 2, a case 3, and a cover 4 as illustrated in FIG. 1. The vehicle door lock device 1 also includes a connection portion 4*a* for electrical connections to external devices, a waterproof cover 7*a*, a waterproof seal 7*b*, and a cable cover 8 as illustrated in FIG. 1.

The door latch device 2 is a device that engages with or disengages from a striker provided on a vehicle body to bring the vehicle door into a closed state or an openable state. As illustrated in FIG. 1, the door latch device 2 is fixed to a part of the case 3 on a vehicle rear side and is supported in this state by the case 3. The door latch device 2 includes a body 21, a cover plate 22, and a latch mechanism 23. The latch mechanism 23 is provided on the body 21 and is covered by the cover plate 22. The cover plate 22 has an entrance groove 22*a* and is attached to the body 21 to render the entrance groove 22*a* open to the latch mechanism 23 in vehicle inner and outer directions. The entrance groove 22*a* is a groove in which the striker of the vehicle enters when the vehicle door is closed.

Figure 2:
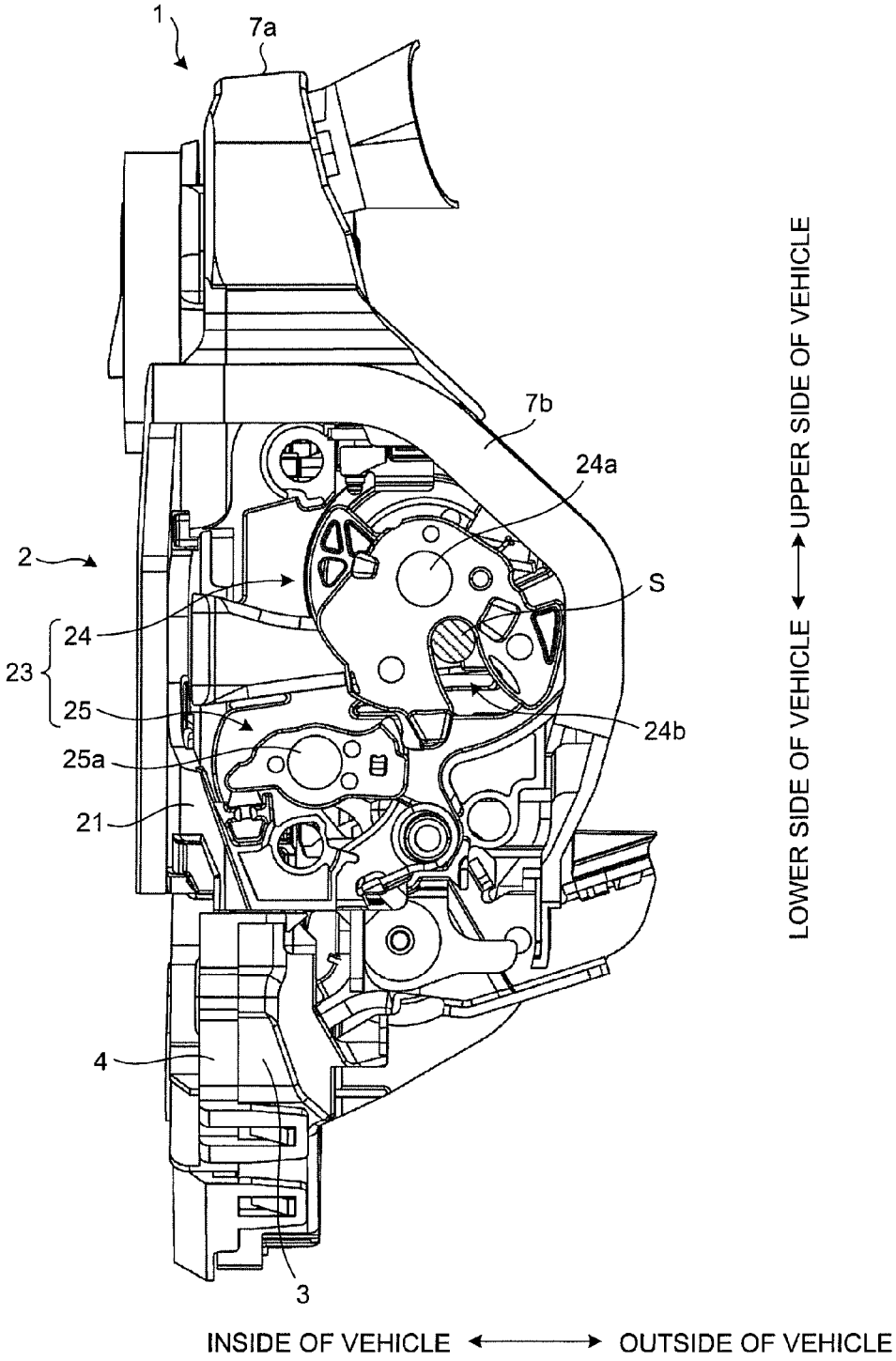
FIG. 2 is a rear view illustrating an example of an internal configuration of a door latch device according to the embodiment of the present invention, as viewed from a vehicle rear side.

FIG. 2 is a rear view illustrating an example of an internal configuration of the door latch device according to the embodiment of the present invention, as viewed from a vehicle rear side. In FIG. 2, the rear view of the vehicle door lock device 1 viewed from the vehicle rear side, from which the cover plate 22 of the door latch device 2 is omitted, is illustrated. As illustrated in FIG. 2, the latch mechanism 23 of the door latch device 2 is a mechanism that engagingly holds a striker S of the vehicle when the door of the vehicle is closed and that releases the striker S when the door is to be open. The latch mechanism 23 includes a latch 24 and a ratchet 25. The latch 24 and the ratchet 25 are provided on the body 21 in a state rotatably supported by a latch shaft 24*a* and a ratchet shaft 25*a*, respectively.

The latch 24 is biased by a spring in a clockwise direction in FIG. 2. The latch 24 receives or releases the striker S when in an unlatch state, and engages with the striker S to hold the striker S with an engagement groove 24*b* when in a half-latch state and a full-latch state. FIG. 2 illustrates the full-latch state of the latch mechanism 23. The ratchet 25 is biased by a spring in a counterclockwise direction in FIG. 2. The ratchet 25 abuts on the latch 24 in a state engaged with the striker S and restricts rotation of the latch 24 in the clockwise direction, that is, rotation of the latch 24 in a direction to switch from the full-latch state or the half-latch state to the unlatch state as illustrated in FIG. 2. The ratchet 25 can stop the latch 24 at a rotational position in the full-latch state or the half-latch state.

Meanwhile, the case 3 and the cover 4 are assembled with each other to configure a housing of the vehicle door lock device 1 as illustrated in FIGS. 1 and 2. The case 3 is a member that houses therein functional components of the vehicle door lock device 1. In the present embodiment, examples of the functional components housed in the case 3 are locking/unlocking members having functions related to switching between locking and unlocking of a door, electronic components of a drive system, switches, and the like, and internal wires required for the electronic components. These functional components will be specifically described later. The cover 4 is a cover member that closes an opening of the case 3.

Connectors for connecting to external devices mounted on the vehicle are connected to the connection portion 4*a*. As illustrated in FIG. 1, the connection portion 4*a* is located at a front part in vehicle front and rear directions on an outer surface of the housing of the vehicle door lock device 1, that is, on the opposite side of the latch mechanism 23 of the door latch device 2 across the locking/unlocking members of the vehicle door lock device 1, and is exposed from the cover 4. For example, connectors of external wires such as a wire harness are connected to the connection portion 4*a*. The external devices mounted on the vehicle, specifically, a control device such as an Electronic Control Unit (ECU) that controls the vehicle door lock device 1 and an in-vehicle power source are electrically connected to the vehicle door lock device 1 via the external wires connected to the connection portion 4*a*.

The waterproof cover 7*a* is a cover member that covers the housing of the vehicle door lock device 1. As illustrated in FIGS. 1 and 2, the waterproof cover 7*a* integrally covers respective edge portions of upper parts (upper side parts in vehicle upper and lower directions), front parts (front side parts in the vehicle front and rear directions), and rear parts (rear side parts in the vehicle front and rear directions) of the case 3 and the cover 4 constituting the housing. The waterproof cover 7*a* prevents water from penetrating into the housing to protect internal components of the vehicle door lock device 1. The waterproof seal 7*b* is a seal member that prevents water from penetrating especially into the inner part of the door latch device 2 in the vehicle door lock device 1. As illustrated in FIGS. 1 and 2, the waterproof seal 7*b* is provided between an end on a vehicle rear side of the waterproof cover 7*a* described above and an upper part of the door latch device 2, and covers a gap between the door latch device 2 and the housing (the case 3 and the cover 4).

The cable cover 8 is a cover member that protects cables that couple the locking/unlocking members in the housing of the vehicle door lock device 1 to a lock knob and an inner handle of a door, and the like. As illustrated in FIG. 1, the cable cover 8 is provided at a lower part (a lower side part in the vehicle upper and lower directions) of the case 3 and the cover 4.

Directions illustrated in FIGS. 1 and 2 are directions in a state where the vehicle door lock device 1 is attached to a door of a vehicle. Hereinafter, similarly, the vehicle front and rear directions, the vehicle upper and lower directions, and the vehicle inner and outer directions in the present embodiment are set as front and rear, upper and lower, and right and left (horizontal) directions of the vehicle door lock device 1 and constituent parts that constitute the vehicle door lock device 1, respectively. The vehicle front and rear directions are front and rear directions of a vehicle in a state where the vehicle door lock device 1 is attached to a door of the vehicle. The vehicle upper and lower directions are upper and lower directions of the vehicle in a state where the vehicle door lock device 1 is attached to a door of the vehicle. The vehicle inner and outer directions are inner and outer directions of the vehicle in a state where the vehicle door lock device 1 is attached to a door of the vehicle. These directions are orthogonal to each other.

Figure 3:
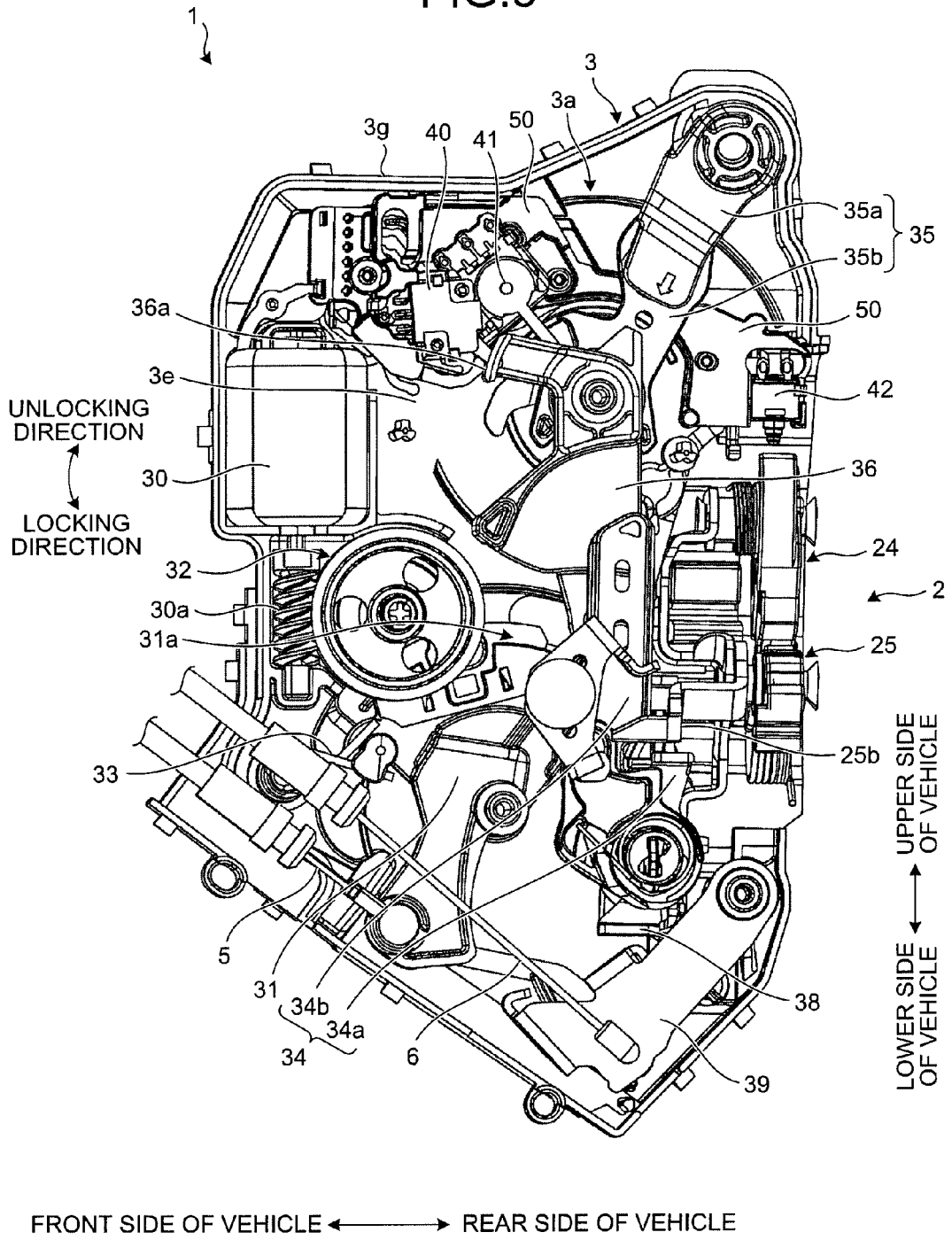
FIG. 3 is a side view illustrating an example of an internal configuration of the vehicle door lock device according to the embodiment of the present invention, as viewed from the inside of a vehicle.
Figure 4:
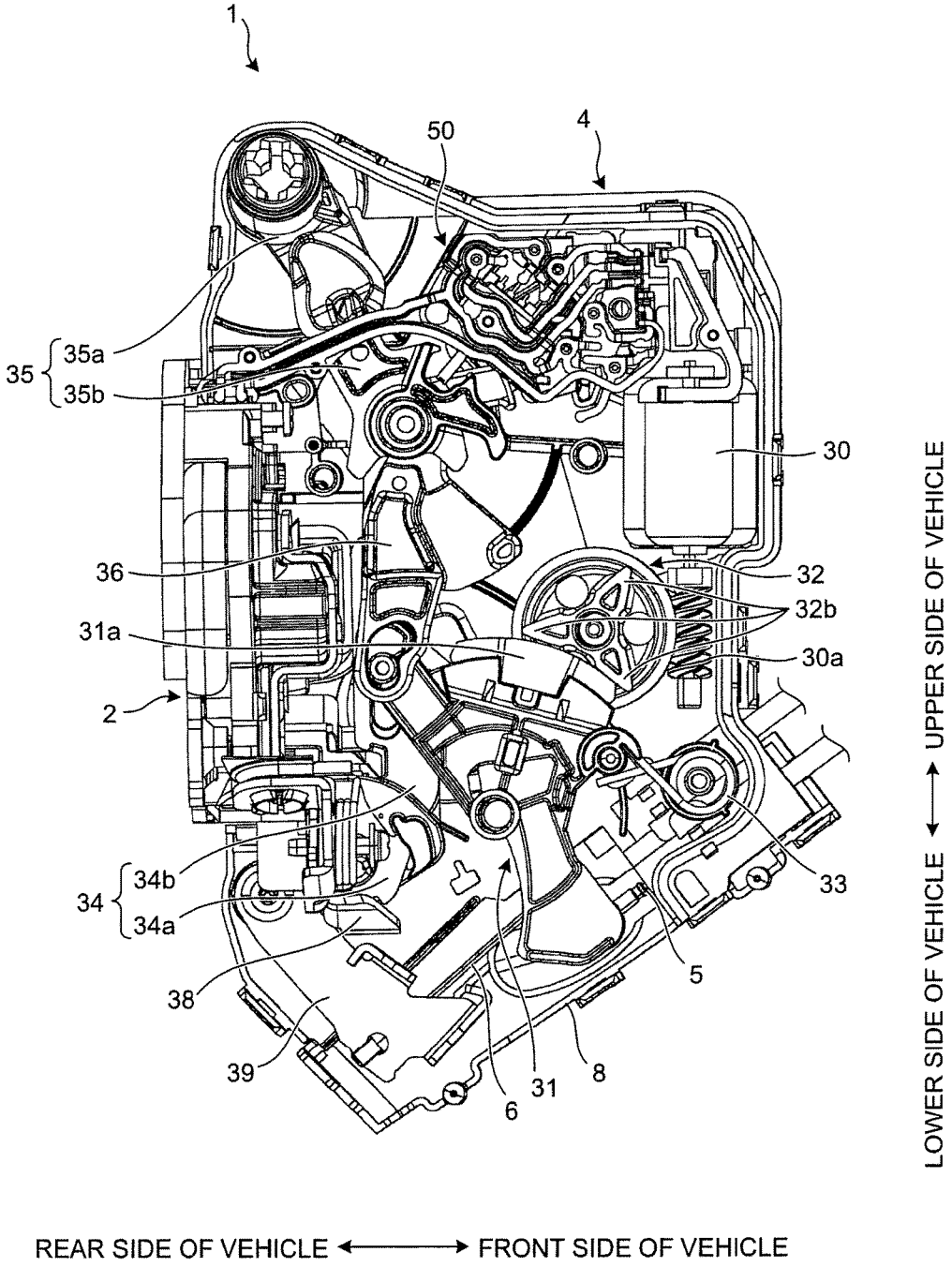
FIG. 4 is a side view illustrating an example of the internal configuration of the vehicle door lock device according to the embodiment of the present invention, as viewed from outside of the vehicle.

FIG. 3 is a side view illustrating an example of an internal configuration of the vehicle door lock device according to the embodiment of the present invention, as viewed from the inside of the vehicle. FIG. 4 is a side view illustrating an example of the internal configuration of the vehicle door lock device according to the embodiment of the present invention, as viewed from outside of the vehicle. As illustrated in FIGS. 3 and 4, the vehicle door lock device 1 includes the functional components such as the door latch device 2, the locking/unlocking members, the electronic components, and the internal wires described above in the housing includes the case 3 and the cover 4. Specifically, as illustrated in FIG. 3, the case 3 has a concave housing portion 3*a*. The housing portion 3*a* is formed by a bottom surface 3*e*, and a wall portion 3*g* surrounding the bottom surface 3*e*. In the present embodiment, the vehicle door lock device 1 includes cables 5 and 6, a lever lock 31, a worm wheel 32, an over-center spring 33, an open member 34, a key member 35, and a coupling member 36 as the locking/unlocking members in the housing portion 3*a*. The vehicle door lock device 1 includes a motor 30, a lock/unlock switch 40, a key switch 41, and a room lamp switch 42 as the electronic components in the housing portion 3*a*, and a switch plate 50 as the internal wires in the housing portion 3*a*. The vehicle door lock device 1 also includes an outside lever 38 and an inside lever 39 working according to a door opening operation for a door of the vehicle in the housing portion 3*a*.

The lever lock 31 is a locking/unlocking member having a function to switch whether a door opening operation for a vehicle is to be transmitted to the door latch device 2, as a function related to switching between locking and unlocking of a door of the vehicle. As illustrated in FIG. 3, the lever lock 31 is located at a central part in the vehicle front and rear directions of the housing portion 3*a* of the case 3, and extends from a lower end part in the vehicle upper and lower directions of the housing portion 3*a* to a position near a central part thereof. The lever lock 31 is supported by a shaft provided on the case 3 to be capable of turning therearound. As illustrated in FIGS. 3 and 4, the lever lock 31 has a silencer 31*a* on an upper part in the vehicle upper and lower directions. The silencer 31*a* transmits power of the motor 30 to the lever lock 31 while meshing with protrusions 32*b* of the worm wheel 32. The lever lock 31 turns in an unlocking direction or a locking direction with the power of the motor 30. This causes the lever lock 31 to switch whether a door opening operation on a door handle is to be transmitted to the door latch device 2.

One end of the cable 5 is connected to the lever lock 31 at a lower part in the vehicle upper and lower directions as illustrated in FIG. 3. Although not particularly illustrated in FIG. 3, the other end of the cable 5 is connected to the lock knob of the door of the vehicle. That is, the lower part of the lever lock 31 is coupled to the lock knob via the cable 5. When a user performs an unlock operation of the lock knob, the lever lock 31 is pulled by the cable 5 and accordingly turns in the unlocking direction. On the other hand, when a user performs a lock operation of the lock knob, the lever lock 31 is pushed by the cable 5 and accordingly turns in the locking direction. In this way, the lever lock 31 turns in the unlocking direction or the locking direction according to an action of the cable 5 corresponding to an unlock operation or a lock operation, and accordingly switches whether a door opening operation on the door handle is to be transmitted to the door latch device 2.

The coupling member 36 is coupled to an upper part in the vehicle upper and lower directions of the lever lock 31 as illustrated in FIG. 4. When the key member 35 performs an action such as rotation due to a key operation by a user, an action corresponding to the key operation is transmitted to the lever lock 31 via the coupling member 36. This causes the lever lock 31 to turn in the unlocking direction or the locking direction to switch whether a door opening operation on the door handle is to be transmitted to the door latch device 2.

The worm wheel 32 is a locking/unlocking member having a function to turn the lever lock 31 in the unlocking direction or the locking direction with the power of the motor 30 as a function related to switching between locking and unlocking of a door of the vehicle. As illustrated in FIG. 3, the worm wheel 32 is located substantially at a center part in the vehicle upper and lower directions of the housing portion 3*a* of the case 3 and is rotatably supported by a shaft provided on the case 3. A helical-gear thread groove is formed on an outer circumferential surface of the worm wheel 32 and the thread groove meshes with a worm 30*a* of the motor 30. The worm wheel 32 also has the protrusions 32*b* as illustrated in FIG. 4. In the present embodiment, three protrusions 32*b* are provided at an equal interval in a circumferential direction of the worm wheel 32. The protrusions 32*b* of the worm wheel 32 mesh with the silencer 31*a* of the lever lock 31 described above and move the silencer 31*a* in the unlocking direction or the locking direction. That is, the worm wheel 32 transmits rotation caused by the power of the motor 30 to the lever lock 31 via the silencer 31*a* and accordingly turns the lever lock 31 in the unlocking direction or the locking direction.

The over-center spring 33 is a locking/unlocking member having a function to apply a biasing force in a turning direction to the lever lock 31 as a function related to switching between locking and unlocking of a door of the vehicle. The over-center spring 33 is a coil spring, and both ends of a wire rod constituting a coil part protrude outward from the coil part and intersect with each other as illustrated in FIGS. 3 and 4. The coil part of the over-center spring 33 is assembled to a shaft provided on the case 3 and is supported thereby. An intersection part of the over-center spring 33 engages with the lever lock 31 as illustrated in FIG. 3. The over-center spring 33 applies the biasing force in the turning direction (specifically, the unlocking direction) to the lever lock 31.

The open member 34 is a locking/unlocking member having a function to switch the state between an unlock position to transmit a door opening operation to the door latch device 2 and a lock position not to transmit a door opening operation to the door latch device 2 as a function related to switching between locking and unlocking of the vehicle door. As illustrated in FIGS. 3 and 4, the open member 34 includes an open link 34*a* and a sub-lever link 34*b*, and is located between the door latch device 2 and the lever lock 31 in the housing portion 3*a* of the case 3.

The open link 34*a* selectively switches the own state between an unlock position and a lock position according to an action of the sub-level link 34*b*. When located at the unlock position, the open link 34*a* faces a release lever 25*b* of the door latch device 2 in the vehicle upper and lower directions as illustrated in FIG. 3. When located at the lock position, the open link 34*a* is in a state not facing the release lever 25*b* in the vehicle upper and lower directions, that is, not abutting on the release lever 25*b*.

The sub-lever link 34*b* is a plate-like member and extends in the vehicle upper and lower directions as illustrated in FIG. 3. The sub-lever link 34*b* has a coupling hole at a lower part and a coupling protrusion of the outside lever 38 is inserted into the coupling hole. The coupling protrusion of the outside lever 38 is a plate-like protruding part. The sub-lever link 34*b* coupled in this manner with the outside lever 38 by insertion of the coupling protrusion into the coupling hole is capable of rotating around the coupling protrusion in a range from a lock position to an unlock position. Furthermore, as illustrated in FIG. 4, a groove extending in a longitudinal direction (that is, the vehicle upper and lower directions) of the sub-lever link 34*b* is provided on an outer surface of the sub-lever link 34*b* in the vehicle inner and outer directions. A protrusion of the lever lock 31 is inserted into the groove of the sub-lever link 34*b*, whereby the sub-lever link 34*b* and the lever lock 31 are coupled with each other.

When a door opening operation is performed on an outer handle or inner handle of a door of vehicle, the outside lever 38 is actuated according to the door opening operation and moves the open link 34*a* to an upper side of the vehicle. When a position of the sub-lever link 34*b* in the rotating direction is the unlock position, the open link 34*a* abuts on the release lever 25*b* of the door latch device 2. The release lever 25*b* is a lever coupled with the ratchet 25 and rotating with the ratchet 25. When the open link 34*a* moves to the vehicle upper side in a state abutting on the release lever 25*b*, the release lever 25*b* and the ratchet 25 rotate in an opening direction (the clockwise direction in FIG. 2). This disengages the ratchet 25 and the latch 24 from each other, and the latch 24 rotates in the opening direction to switch the latch mechanism 23 (see FIG. 2) from the full-latch state or the half-latch state to the unlatch state. As described above, the open member 34 in which the open link 34*a* and the sub-lever link 34*b* are at the unlock position is in a state to transmit a door opening operation to the door latch device 2.

Meanwhile, when a user performs a lock operation with a key or a lock knob and when the motor 30 provides power in the locking direction to the lever lock 31 via the worm wheel 32, the lever lock 31 turns in the locking direction. The open member 34 also turns in the locking direction along with the turning of the lever lock 31. Accordingly, the sub-lever link 34*b* of the open member 34 switches the state from the unlock position to the lock position. When a position of the sub-lever link 34*b* in the rotating direction is the lock position, the open link 34*a* does not abut on the release lever 25*b* even when moving to the vehicle upper part. That is, the open member 34 in which the open link 34*a* and the sub-lever link 34*b* are at the lock position is in a state not to transmit a door opening operation to the door latch device 2.

When a user performs an unlock operation with a key or a lock knob in a state where the open member 34 is located at the lock position and when the motor 30 provides power in the unlocking direction to the lever lock 31 via the worm wheel 32, the lever lock 31 turns in the unlocking direction. The open member 34 turns in the unlocking direction along with the turning of the lever lock 31 and accordingly switches the state from the lock position to the unlock position.

The key member 35 is a locking/unlocking member having a function to selectively switch the state of the open member 34 between the lock position and the unlock position according to a lock operation and an unlock operation of a user with a key as a function related to switching between locking and unlocking of a vehicle door. As illustrated in FIGS. 3 and 4, the key member 35 includes an access key 35*a* and a sub-lever key 35*b* and is located at an upper part in the vehicle upper and lower directions of the housing portion 3*a* of the case 3.

The access key 35*a* is a lever member that turns according to a key operation (a lock operation and an unlock operation) by a user and is attached to the case 3 to be capable of turning. When a user performs a lock operation with a key, the access key 35*a* performs an action (hereinafter, "lock action") corresponding to the lock operation. When a user performs an unlock operation with the key, the access key 35*a* performs an action (hereinafter, "unlock action") corresponding to the unlock operation.

The sub-lever key 35*b* is a member that turns according to a lock action and an unlock action of the access key 35*a* and is placed in the housing portion 3*a* of the case 3 to couple the access key 35*a* and the coupling member 36 to each other as illustrated in FIGS. 3 and 4. The sub-lever key 35*b* transmits a lock action of the access key 35*a* to the coupling member 36 to actuate the coupling member 36. This causes the lever lock 31 to turn in the locking direction to switch the state of the open member 34 from the unlock position to the lock position. On the other hand, the sub-lever key 35*b* transmits an unlock action of the access key 35*a* to the coupling member 36 to actuate the coupling member 36. This causes the lever lock 31 to turn in the unlocking direction to switch the state of the open member 34 from the lock position to the unlock position.

The coupling member 36 is a locking/unlocking member having a function to transmit a lock action and an unlock action of the key member 35 to the lever lock 31 as a function related to switching between locking and unlocking of a vehicle door. As illustrated in FIGS. 3 and 4, the coupling member 36 couples the sub-lever key 35*b* of the key member 35 and the lever lock 31 to each other to be capable of turning. The coupling member 36 turns according to a lock action of the key member 35 and accordingly turns the lever lock 31 in the locking direction. On the other hand, the coupling member 36 turns according to an unlock action of the key member 35 and accordingly turns the lever lock 31 in the unlocking direction.

The outside lever 38 is a member that is actuated according to a door opening operation on an outer handle (not illustrated) of a vehicle door and is placed between the open member 34 and the inside lever 39 as illustrated in FIGS. 3 and 4. The outside lever 38 is coupled to the outer handle. When a door opening operation on the outer handle is performed, the outside lever 38 is actuated according to the door opening operation and moves the open link 34*a* to the upper side of the vehicle.

The inside lever 39 is a member that is actuated according to a door opening operation on an inner handle (not illustrated) of a vehicle door and is placed on a lower side of the vehicle than the outside lever 38 as illustrated in FIGS. 3 and 4. One end of the cable 6 is coupled to the inside lever 39 as illustrated in FIG. 3. The other end of the cable 6 is coupled to the inner handle. When a door opening operation on the inner handle is performed, the inside lever 39 is actuated according to the door opening operation to move the open link 34*a* to the upper side of the vehicle.

Meanwhile, the motor 30 is an electronic component functioning as a drive source for turning the lever lock 31 described above. As illustrated in FIGS. 3 and 4, the motor 30 is located on a front part in the vehicle front and rear directions of the housing portion 3*a* of the case 3. The motor 30 has the worm 30*a* on its own drive shaft and consumes power supplied via the switch plate 50 to rotatably drive the worm 30*a* along with the drive shaft. This enables the motor 30 to transmit power to the worm wheel 32 via the worm 30*a* and rotate the worm wheel 32 in the locking direction or the unlocking direction. As a result, the motor 30 turns the lever lock 31 in the locking direction or the unlocking direction.

The lock/unlock switch 40 and the key switch 41 are electronic components functioning as a first switch that detects states of the locking/unlocking members corresponding to switching between locking and unlocking of a vehicle door. As illustrated in FIG. 3, the lock/unlock switch 40 and the key switch 41 in a state assembled to the switch plate 50 are located at a position nearer a vehicle front side than the locking/unlocking members (specifically, the key member 35 and the coupling member 36) in the housing portion 3*a* of the case 3.

The lock/unlock switch 40 has a movable element capable of turning and is associated with the coupling member 36 in a manner in which the movable element is inserted through an opening provided in the coupling member 36 as illustrated in FIG. 3. The lock/unlock switch 40 detects a turning position of the coupling member 36 that is switched according to a lock action or an unlock action of the key member 35 based on turning of the movable element, and detects whether the state of the open member 34 is the lock position or the unlock position based on a result of the detection.

The key switch 41 has a movable element capable of turning and is associated with the sub-lever key 35*b* in a manner in which the movable element is put in a concave portion of the sub-lever key 35*b* as illustrated in FIG. 3. The key switch 41 detects a turning position of the sub-lever key 35*b* that is switched according to a lock action or an unlock action of the access key 35*a* based on turning of the movable element, and detects whether a key operation performed by a user is a lock operation or an unlock operation based on a result of the detection.

The room lamp switch 42 is an electronic component functioning as a second switch that switches between on and off of a room lamp of the vehicle according to a turning position of the latch 24 of the latch mechanism 23 (see FIG. 2) in the door latch device 2. As illustrated in FIG. 3, the room lamp switch 42 in a state assembled to the switch plate 50 is located at a position nearer a rear side of the vehicle than the locking/unlocking members (specifically, the key member 35 and the coupling member 36) in the housing portion 3*a* of the case 3.

In the present embodiment, as illustrated in FIG. 3, the room lamp switch 42 in a state held by the switch plate 50 is located near an outer circumference of the latch 24 to be capable of lying adjacent to the latch 24 from an upper side of the vehicle. The room lamp switch 42 is an ajar switch and has a movable element that is biased by a spring (not illustrated) to be capable of protruding and retracting. Based on a protruded or retracted state of the movable element, the room lamp switch 42 detects that the latch 24 is at a turning position other than a position in the full-latch state. At that time, the room lamp switch 42 detects whether the turning position of the latch 24 is nearer the unlatch position than a position between the full-latch position and the half-latch position. When the room lamp switch 42 detects that the turning position of the latch 2324 is a position other than the full-latch position (that the door is half-shut or open), the room lamp of the vehicle is turned on. On the other hand, when the turning position of the latch 24 is the full-latch position (the door is fully closed), the room lamp switch 42 turns off the room lamp of the vehicle.

The switch plate 50 is an internal wire required to realize the functions of the electronic components (the motor 30, the lock/unlock switch 40, the key switch 41, and the room lamp switch 42 according to the present embodiment) of the vehicle door lock device 1. As illustrated in FIGS. 3 and 4, the switch plate 50 is placed at an upper part in the vehicle upper and lower directions of the housing portion 3*a* of the case 3. At that time, the switch plate 50 is assembled to the housing portion 3*a* to pass through between the locking/unlocking members such as the key member 35 and the case 3 (between the key member 35 and the bottom surface 3*e* of the housing portion 3*a* according to the present embodiment) to extend in the vehicle front and rear directions. The switch plate 50 electrically connects each of the motor 30, the lock/unlock switch 40, the key switch 41, and the room lamp switch 42 to the connection portion 4*a* (see FIG. 1).

(Configuration of Switch Plate)

Figure 5:
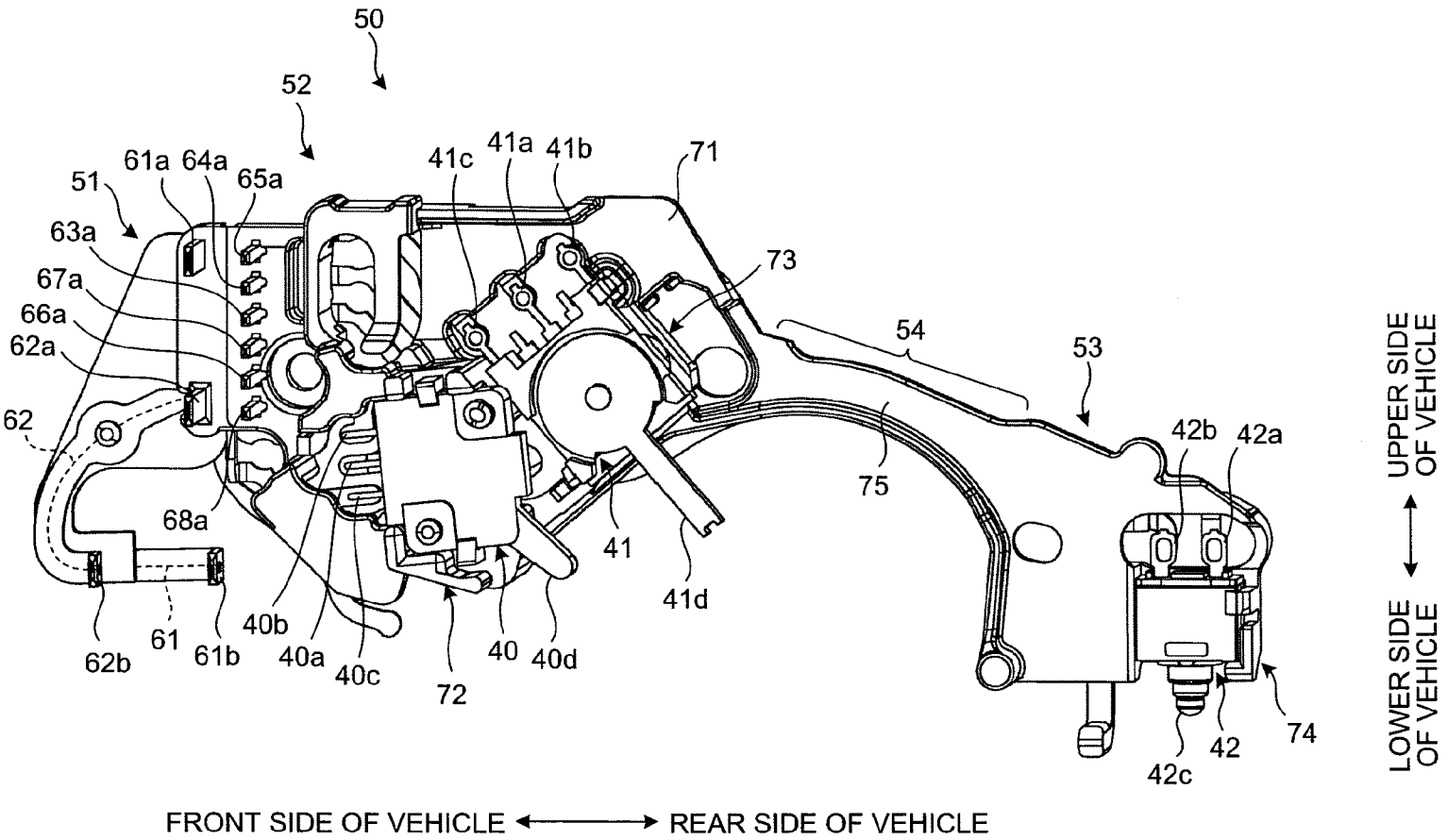
FIG. 5 is a side view illustrating a configuration example of a switch plate being an internal wire of the vehicle door lock device according to the embodiment of the present invention, as viewed from the inside of the vehicle.
Figure 6:
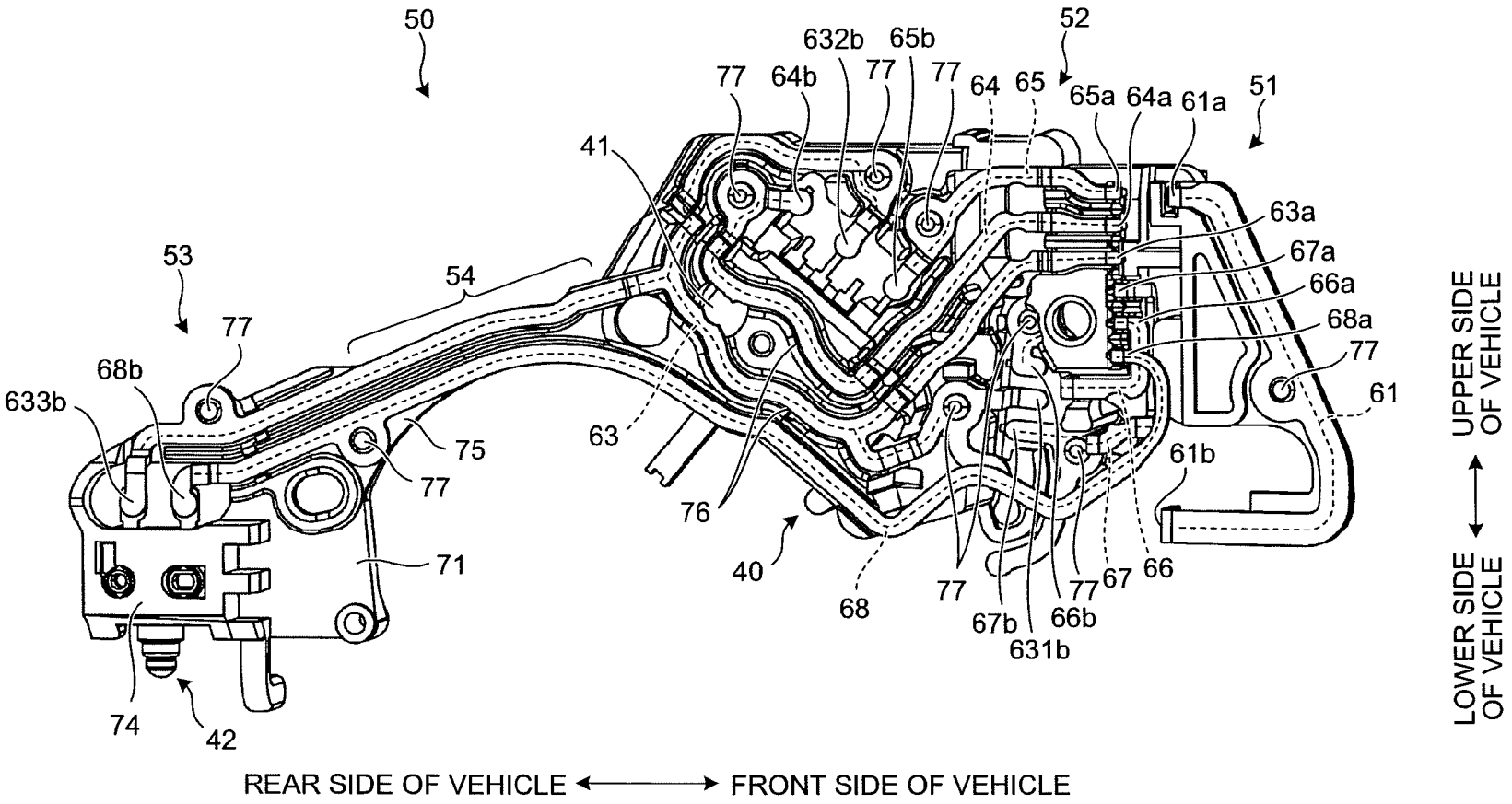
FIG. 6 is a side view illustrating a configuration example of the switch plate being the internal wire of the vehicle door lock device according to the embodiment of the present invention, as viewed from outside of the vehicle.
Figure 7:
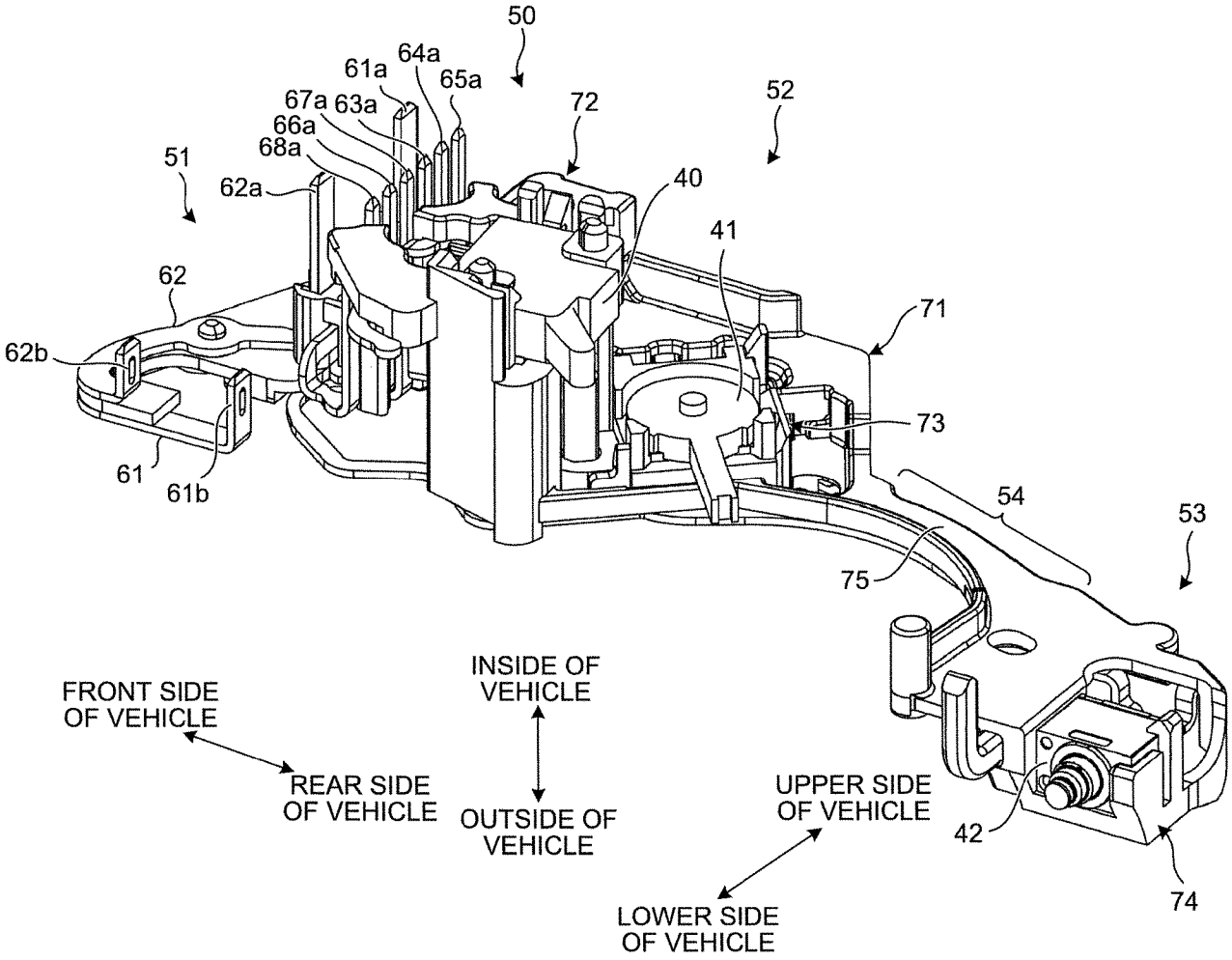
FIG. 7 is a perspective view illustrating a configuration example of the switch plate being the internal wire of the vehicle door lock device according to the embodiment of the present invention.

A configuration of the switch plate 50 which is the internal wire of the vehicle door lock device 1 according to the embodiment of the present invention is described next. FIG. 5 is a side view illustrating an example configuration of the switch plate being the internal wire of the vehicle door lock device according to the embodiment of the present invention, as viewed from the inside of the vehicle. FIG. 6 is a side view illustrating an example configuration of the switch plate being the internal wire of the vehicle door lock device according to the embodiment of the present invention, as viewed from outside of the vehicle. FIG. 7 is a perspective view illustrating an example configuration of the switch plate being the internal wire of the vehicle door lock device according to the embodiment of the present invention.

The switch plate 50 is an internal wire electrically connecting at least the first switch and the second switch to the connection portion 4*a* (see FIG. 1) described above. In the present embodiment, as illustrated in FIGS. 5 to 7, the switch plate 50 electrically connects the motor 30 (see FIGS. 3 and 4), the lock/unlock switch 40 and the key switch 41 serving as the first switch, and the room lamp switch 42 serving as the second switch to the connection portion 4*a* described above. The switch plate 50 includes a motor plate 51, a first switch plate 52, a second switch plate 53, and a switch-plate joining portion 54.

The motor plate 51 is a wire plate electrically connecting the motor 30 to the connection portion 4*a* described above. The motor plate 51 is located on the opposite side of the latch mechanism 23 of the door latch device 2 across the locking/unlocking members of the vehicle door lock device 1 (see FIGS. 2 and 3). As illustrated in FIGS. 5 to 7, the motor plate 51 according to the present embodiment is a front end part of the switch plate 50 in the vehicle front and rear directions. The motor plate 51 has a first conduction plate 61 and a second conduction plate 62. The first conduction plate 61 and the second conduction plate 62 are conductive plate-like members such as copper, respectively, and are formed, for example, by being punched through pressing. The first conduction plate 61 is connected to one terminal of the motor 30 and the second conduction plate 62 is connected to the other terminal of the motor 30. A current is supplied to the motor 30 via the first conduction plate 61 and the second conduction plate 62.

End parts (terminals) 61*a* and 61*b* on both sides of the first conduction plate 61 are bent toward the inside of the vehicle as illustrated in FIGS. 5 and 7. Similarly, end parts (terminals) 62*a* and 62*b* on both sides of the second conduction plate 62 are bent toward the inside of the vehicle as illustrated in FIGS. 5 and 7. The terminals 61*a* and 62*a* are located at the connection portion 4*a* illustrated in FIG. 1. The other terminals 61*b* and 62*b* are connected to the motor 30 by being inserted into fitting holes of the motor 30, respectively, illustrated in FIGS. 3 and 4.

The first switch plate 52 is a wire plate electrically connecting mainly the lock/unlock switch 40 and the key switch 41 to the connection portion 4*a* described above. The first switch plate 52 is located at the opposite side of the latch mechanism 23 across the locking/unlocking members described above (see FIGS. 2 and 3), that is, at the same side as that of the connection portion 4*a* illustrated in FIG. 1. As illustrated in FIGS. 5 to 7, the first switch plate 52 according to the present embodiment is a portion of the switch plate 50 between the motor plate 51 and the switch-plate joining portion 54. The first switch plate 52 has a third conduction plate 63, a fourth conduction plate 64, a fifth conduction plate 65, a sixth conduction plate 66, a seventh conduction plate 67, and an eighth conduction plate 68.

The third conduction plate 63 is a conduction plate electrically connecting the lock/unlock switch 40, the key switch 41, and the room lamp switch 42 to the connection portion 4*a* described above. The third conduction plate 63 is a conductive plate-like member such as copper and is formed, for example, by being punched through pressing into a shape branching off from the side of the connection portion 4*a* into the side of the lock/unlock switch 40, the side of the key switch 41, and the side of the room lamp switch 42 as illustrated in FIG. 6.

As illustrated in FIGS. 5 and 7, an end part (terminal) 63*a* of the third conduction plate 63 on the side of the connection portion 4*a* is bent toward the inside of the vehicle. The terminal 63*a* is placed at the connection portion 4*a* illustrated in FIG. 1. On the other hand, an end part (terminal) 631*b* of the third conduction plate 63 on the side of the lock/unlock switch 40 is connected to a terminal 40*a* (see FIG. 5) of the lock/unlock switch 40 in a state assembled to the first switch plate 52 by resistance welding or the like. An end part (terminal) 632*b* of the third conduction plate 63 on the side of the key switch 41 is connected to a terminal 41*a* (see FIG. 5) of the key switch 41 in a state assembled to the first switch plate 52 by resistance welding or the like. An end part (terminal) 633*b* of the third conduction plate 63 on the side of the room lamp switch 42 is electrically connected to the room lamp switch 42 of the second switch plate 53, which will be described later. Power is supplied from an external device to the lock/unlock switch 40, the key switch 41, and the room lamp switch 42 via the third conduction plate 63.

The fourth conduction plate 64 and the fifth conduction plate 65 are conduction plates electrically connecting the key switch 41 to the connection portion 4*a* described above. The fourth conduction plate 64 and the fifth conduction plate 65 are conductive plate-like members such as copper, respectively, and are formed, for example, by being punched through pressing. As illustrated in FIGS. 5 and 7, one end part (terminal) 64*a* of the fourth conduction plate 64 is bent toward the inside of the vehicle. Similarly, one end part (terminal) 65*a* of the fifth conduction plate 65 is bent toward the inside of the vehicle. These terminals 64*a* and 65*a* are located at the connection portion 4*a* illustrated in FIG. 1. The other end part (terminal) 64*b* of the fourth conduction plate 64 is connected to a terminal 41*b* (see FIG. 5) of the key switch 41 in a state assembled to the first switch plate 52 by resistance welding or the like. The other end part (terminal) 65*b* of the fifth conduction plate 65 is connected to a terminal 41*c* (see FIG. 5) of the key switch 41 by resistance welding or the like. An electrical signal is transmitted and received between the key switch 41 and an external device via the fourth conduction plate 64 or the fifth conduction plate 65.

The sixth conduction plate 66 and the seventh conduction plate 67 are conduction plates electrically connecting the lock/unlock switch 40 to the connection portion 4*a* described above. The sixth conduction plate 66 and the seventh conduction plate 67 are conductive plate-like members such as copper, respectively, and are formed, for example, by being punched through pressing. As illustrated in FIGS. 5 and 7, one end part (terminal) 66*a* of the sixth conduction plate 66 is bent toward the inside of the vehicle. Similarly, one end part (terminal) 67*a* of the seventh conduction plate 67 is bent toward the inside of the vehicle. These terminals 66*a* and 67*a* are located at the connection portion 4*a* illustrated in FIG. 1. The other end part (terminal) 66*b* of the sixth conduction plate 66 is connected to a terminal 40*b* (see FIG. 5) of the lock/unlock switch 40 in a state assembled to the first switch plate 52 by resistance welding or the like. The other end part (terminal) 67*b* of the seventh conduction plate 67 is connected to a terminal 40*c* (see FIG. 5) of the lock/unlock switch 40 by resistance welding or the like. An electrical signal is transmitted and received between the lock/unlock switch 40 and an external device via the sixth conduction plate 66 or the seventh conduction plate 67.

The eighth conduction plate 68 is a conduction plate electrically connecting the room lamp switch 42 to the connection portion 4*a* described above. The eighth conduction plate 68 is a conductive plate-like member such as copper and is formed, for example, by being punched through pressing. As illustrated in FIGS. 5 and 7, one end part (terminal) 68*a* of the eighth conduction plate 68 is bent toward the inside of the vehicle. The other end part (terminal) 68*b* of the eighth conduction plate 68 is electrically connected to the room lamp switch 42 of the second switch plate 53, which will be described later.

The second switch plate 53 is a wire plate electrically connecting the room lamp switch 42 to the connection portion 4*a* described above. The second switch plate 53 is located on the opposite side of the first switch plate 52 across the locking/unlocking members described above, that is, the same side as that of the latch mechanism 23 of the door latch device 2. As illustrated in FIGS. 5 to 7, the second switch plate 53 according to the present embodiment is a rear end part of the switch plate 50 in the vehicle front and rear directions and includes a branched plate of the third conduction plate 63 described above and the eighth conduction plate 68.

The branched plate of the third conduction plate 63 included in the second switch plate 53 is a conduction plate branching off from the third conduction plate 63 located on the first switch plate 52 described above to the side of the room lamp switch 42. The branched plate of the third conduction plate 63 is located on a part of the switch plate 50 extending from the first switch plate 52 to the second switch plate 53 through the switch-plate joining portion 54 as illustrated in FIG. 6. The terminal 633*b* of the branched plate of the third conduction plate 63 is connected to a terminal 42*a* (see FIG. 5) of the room lamp switch 42 in a state assembled to the second switch plate 53 by resistance welding or the like. Power is supplied from an external device to the room lamp switch 42 via the third conduction plate 63 including the branched plate.

The eighth conduction plate 68 is the conduction plate electrically connecting the room lamp switch 42 to the connection portion 4*a* as described above. The terminal 68*a* of the eighth conduction plate 68 on the side of the connection portion 4*a* is located on the first switch plate 52 as described above. The eighth conduction plate 68 is located on a part of the switch plate 50 extending from the part of the terminal 68*a* to the second switch plate 53 through the first switch plate 52 and the switch-plate joining portion 54 as illustrated in FIG. 6. The other terminal 68*b* of the eighth conduction plate 68 is connected to a terminal 42*b* (see FIG. 5) of the room lamp switch 42 in a state assembled to the second switch plate 53 by resistance welding or the like. An electrical signal is transmitted and received between the room lamp switch 42 and an eternal device via the eighth conduction plate 68.

The switch-plate joining portion 54 is a part of the switch plate 50 joining the first switch plate 52 and the second switch plate 53 to each other. In the present embodiment, the switch-plate joining portion 54 connects the first switch plate 52 and the second switch plate 53 being separated on a front side and a rear side in the vehicle front and rear directions together as illustrated in FIGS. 5 to 7.

Meanwhile, as illustrated in FIGS. 5 to 7, the switch plate 50 includes a resin base material 71 as a member constituting an integrated substrate. The resin base material 71 is formed, for example, by integral molding using a resin. The resin base material 71 has groove portions 76 and protrusion portions 77 corresponding to the conduction plates, respectively, as illustrated in FIG. 6. The first conduction plate 61, the second conduction plate 62, the third conduction plate 63, the fourth conduction plate 64, the fifth conduction plate 65, the sixth conduction plate 66, the seventh conduction plate 67, and the eighth conduction plate 68 described above are fitted to the corresponding groove portions 76 or the corresponding protrusion portions 77 by a method such as press fitting or thermal caulking and thereby are assembled to the resin base material 71.

A required number of through holes, into which the shafts provided on the bottom surface 3*e* of the case 3 illustrated in FIG. 3 are inserted, are provided in the resin base material 71. When the switch plate 50 is to be assembled to the housing portion 3*a* of the case 3, the shafts of the case 3 are inserted into the corresponding through holes of the resin base material 71, respectively. In this way, the resin base material 71 is positioned and fixed (that is, the switch plate 50 is positioned and fixed) to the case 3.

The first switch plate 52 has first-switch holding portions 72 and 73 that hold the lock/unlock switch 40 and the key switch 41 serving as the first switch, respectively, on a substrate portion formed by the resin base material 71. As illustrated in FIGS. 5 and 7, the first-switch holding portions 72 and 73 are concave portions formed integrally on the resin base material 71, respectively. The first-switch holding portion 72 immovably holds the body of the lock/unlock switch 40. Accordingly, the first-switch holding portion 72 positions the lock/unlock switch 40 with respect to the coupling member 36 in such a manner that a movable element 40*d* of the lock/unlock switch 40 is turned on or off by a movable-element pressing portion 36*a* of the coupling member 36 (see FIG. 3). The first-switch holding portion 73 immovably holds the body of the key switch 41. Accordingly, the first-switch holding portion 73 positions the key switch 41 with respect to the sub-lever key 35*b* in such a manner that a movable element 41*d* of the key switch 41 is located in a concave portion of the sub-lever key 35*b* (see FIG. 3).

The second switch plate 53 has a second-switch holding portion 74 that holds the room lamp switch 42 serving as the second switch on a substrate portion formed by the resin base material 71. As illustrated in FIGS. 5 and 7, the second-switch holding portion 74 is a concave portion formed integrally on the resin base material 71 and immovably holds the body of the room lamp switch 42. In this manner, the second-switch holding portion 74 positions the room lamp switch 42 with respect to the latch 24 to cause a movable element 42*c* of the room lamp switch 42 to face an outer circumferential surface of the latch 24 (see FIG. 3).

As illustrated in FIGS. 5 to 7, a substrate portion of the switch-plate joining portion 54 that joins the first switch plate 52 and the second switch plate 53 together includes a base-material joining portion 75 of the resin base material 71. The base-material joining portion 75 joins a part of the resin base material 71 forming the substrate portion of the first switch plate 52 and a part of the resin base material 71 forming the substrate portion of the second switch plate 53 together. As illustrated in FIG. 6, the branched plate of the third conduction plate 63 and the eighth conduction plate 68 are assembled to a surface of the base-material joining portion 75 on outside of the vehicle.

Figure 8:
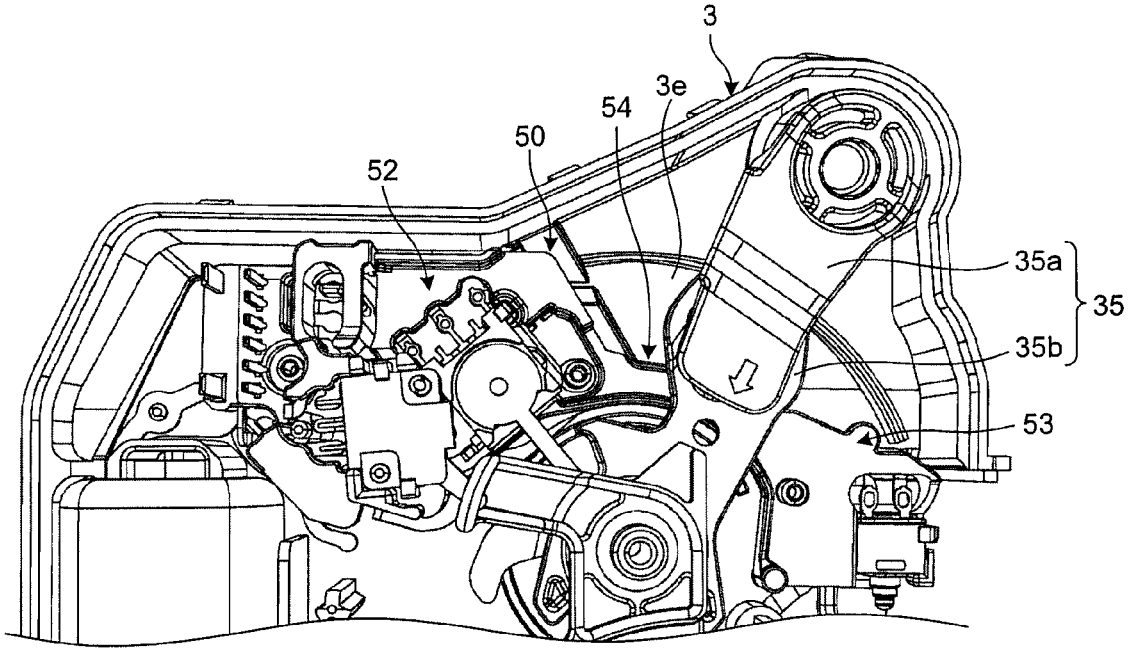
FIG. 8 is an explanatory diagram for explaining a placement relation in a case between the switch plate and locking/unlocking members according to the embodiment of the present invention.

FIG. 8 is an explanatory diagram explaining a placement relationship between the switch plate and the locking/unlocking members in the case according to the embodiment of the present invention. As illustrated in FIGS. 3 and 8 described above, in the state where the locking/unlocking members such as the key member 35 and the switch plate 50 are assembled to the housing portion 3*a* of the case 3, the first switch plate 52 is located on the opposite side of the latch mechanism 23 (see FIG. 2) of the door latch device 2 across the locking/unlocking members, that is, on the same side as that of the connection portion 4*a* illustrated in FIG. 1. In this state, the second switch plate 53 is located on the opposite side of the first switch plate 52 across the locking/unlocking members, that is, located on the same side as that of the latch mechanism 23 of the door latch device 2.

The locking/unlocking members according to the present embodiment are the members having the functions related to switching between locking and unlocking of a vehicle door as described above. Specifically, as illustrated in FIG. 3, the locking/unlocking members include the lever lock 31, the worm wheel 32, the open member 34, the key member 35, the coupling member 36, and the like, that lie in a row in the vehicle upper and lower directions in a state assembled to the housing portion 3*a* of the case 3. The locking/unlocking members are in a state dividing the housing portion 3*a* of the case 3 into a region on a rear side of the vehicle in which the latch mechanism 23 (including the latch 24 and the ratchet 25) is placed and a region on a front side of the vehicle in which the connection portion 4*a* (see FIG. 1) for providing conduction with the external devices is located as illustrated in FIG. 3. The first switch plate 52 on which the terminals of the respective conduction plates of the switch plate 50 are collected is required to be located in the region on the vehicle front side near the connection portion 4*a*. On the other hand, the second switch plate 53 holding the room lamp switch 42 that detects a turning position of the latch 24 is required to be located in the region on the vehicle rear side in which the latch mechanism 23 is placed.

The first switch plate 52 and the second switch plate 53 that are in the state separated on the vehicle front side and the vehicle rear side across the locking/unlocking members as described above are joined together by the switch-plate joining portion 54. At that time, the switch-plate joining portion 54 is interposed between the case 3 that houses at least the locking/unlocking members and the switch plate 50, and the locking/unlocking members described above. Specifically, in the present embodiment, the locking/unlocking members include the key member 35 that performs an action related to switching between locking and unlocking of a vehicle door corresponding to a lock/unlock operation with a key. The switch-plate joining portion 54 is interposed between the bottom surface 3*e* (the housing surface) of the case 3 and the key member 35 (the access key 35*a* and the sub-lever key 35*b*) as illustrated, for example, in FIG. 8, and joins and integrates the first switch plate 52 and the second switch plate 53 together in this state.

As described above, in the embodiment of the present invention, the switch-plate joining portion 54 that joins together the first switch plate 52 that is located on the opposite side of the latch mechanism 23 across the locking/unlocking members described above, and the second switch plate 53 that is located on the opposite side of the first switch plate 52 across the locking/unlocking members described above in a state where at least the switch plate 50 and the locking/unlocking members are assembled to the case 3 is configured to be interposed between the case 3 and the locking/unlocking members described above.

Therefore, the first switch (the lock/unlock switch 40 and the key switch 41, for example) that is located on the opposite side of the latch mechanism 23 across the locking/unlocking members described above and that detects the states of the locking/unlocking members according to switching between locking and unlocking of a vehicle door can be electrically connected to the connection portion 4*a* for connections of external wire connectors leading to the external devices with a simple structure via the first switch plate 52. Furthermore, the second switch plate 53 that electrically connects the second switch (the room lamp switch 42, for example) that switches between on and off of the room lamp of the vehicle according to a turning position of the latch 24 of the latch mechanism 23 to the connection portion 4*a* can be integrated with the first switch plate 52 with a simple structure via the switch-plate joining portion 54. As a result, a special structure for avoiding contact between the locking/unlocking members described above and the switch-plate joining portion 54 does not need to be provided in the locking/unlocking members described above and the switch-plate joining portion 54. Furthermore, the integrated switch plate 50 serving as internal wires required for a number of electronic components, such as switches, demanded by the vehicle door lock device 1 can be easily assembled to the case 3. Accordingly, an increase in the labor and cost of assembly of the vehicle door lock device 1 can be prevented as much as possible.

In the embodiment of the present invention, the first-switch holding portion that holds the first switch is provided on the first switch plate 52, and the second-switch holding portion that holds the second switch is provided on the second switch plate 53. Therefore, a number of switches demanded by the vehicle door lock device 1 (a total of three switches including the lock/unlock switch 40, the key switch 41, and the room lamp switch 42, for example) can be mounted on the switch plate 50. By assembling the switch plate 50 in a state where a required number of switches are mounted thereon to the case 3 as described above, the required number of switches and the switch plate 50 can be easily assembled to the case 3 and also the required number of switches can be placed at appropriate positions, respectively, in the case 3.

In the embodiment described above, the vehicle door lock device 1 in which the key member 35 that is actuated according to a lock/unlock operation with a key is included in the locking/unlocking members is illustrated as an example. However, the present invention is not limited to this example. In the present invention, the key member 35 is not necessarily included in the locking/unlocking members of the vehicle door lock device 1. In this case, the locking/unlocking members may include a member that performs a lock/unlock action in conjunction with lock/unlock of other doors in place of the key member 35.

In the embodiment described above, the switch-plate joining portion 54 is interposed between the key member 35 among the locking/unlocking members and the case 3. However, the present invention is not limited thereto. In the present invention, the switch-plate joining portion 54 may be interposed between a locking/unlocking member (the coupling member 36, for example) other than the key member 35 and the case 3.

Furthermore, in the embodiment described above, the lock/unlock switch 40 and the key switch 41 are illustrated as an example of the first switch that detects the states of the locking/unlocking members corresponding to switching between locking and unlocking of a vehicle door. However, the present invention is not limited thereto. In the present invention, the first switch may be any switch other than the lock/unlock switch 40 and the key switch 41 as long as it detects the states of the locking/unlocking members described above, or may be any one of these switches.

In the embodiment described above, the switch plate 50 having two switches (the lock/unlock switch 40 and the key switch 41) mounted on the first switch plate 52 and one switch (the room lamp switch 42) mounted on the second switch plate 53, that is, the switch plate 50 having a total of three switches mounted thereon is illustrated as an example. However, the present invention is not limited thereto. In the present invention, the switch plate 50 may have one switch or a plurality of switches mounted on the first switch plate 52 and may have one switch or a plurality of switches mounted on the second switch plate 53. The numbers of first switches and second switches mounted on the switch plate 50 are not particularly specified.

The present invention is not limited the embodiment described above, and other embodiments in which the constituent elements described above are combined as appropriate are also included in the present invention. In addition, all of other embodiments, examples, operational techniques, and the like that are achieved by persons skilled in the art based on the embodiment described above are also included in the scope of the present invention.

INDUSTRIAL APPLICABILITY

As described above, the vehicle door lock device according to the present invention is useful for easy assembly of electronic components and internal wires incorporated in the housing, and is particularly suitable for a vehicle door lock device that can prevent an increase in the labor and cost of assembly as much as possible.

REFERENCE SIGNS LIST

1 vehicle door lock device
2 door latch device
3 case
3*a* housing portion
3*e* bottom surface
3*g* wall portion
4 cover
4*a* connection portion
5, 6 cable
7*a* waterproof cover
7*b* waterproof seal
8 cable cover
21 body
22 cover plate
22*a* entrance groove
23 latch mechanism
24 latch
24*a* latch shaft
24*b* engagement groove
25 ratchet
25*a* ratchet shaft
25*b* release lever
30 motor
30*a* worm
31 lever lock
31*a* silencer
32 worm wheel
32*b* protrusion
33 over-center spring
34 open member
34*a* open link
34*b* sub-lever link
35 key member
35*a* access key
35*b* sub-lever key
36 coupling member
36*a* movable-element pressing portion
38 outside lever
39 inside lever
40 lock/unlock switch (first switch)
40*a*, 40*b*, 40*c* terminal
40*d* movable element
41 key switch (first switch)
41*a*, 41*b*, 41*c* terminal
41*d* movable element
42 room lamp switch (second switch)
42*a*, 42*b* terminal
42*c* movable element
50 switch plate
51 motor plate
52 first switch plate
53 second switch plate
54 switch-plate joining portion
61 first conduction plate
61*a*, 61*b* terminal
62 second conduction plate
62*a*, 62*b* terminal
63 third conduction plate
63*a*, 631*b*, 632*b*, 633*b* terminal
64 fourth conduction plate
64*a*, 64*b* terminal
65 fifth conduction plate
65*a*, 65*b* terminal
66 sixth conduction plate
66*a*, 66*b* terminal
67 seventh conduction plate
67*a*, 67*b* terminal
68 eighth conduction plate
68*a*, 68*b* terminal
71 resin base material
72, 73 first-switch holding portion
74 second-switch holding portion
75 base-material joining portion
76 groove portion
77 protrusion portion
S striker

The invention claimed is:

1. A vehicle door lock device comprising:

a latch mechanism configured to engagingly hold a striker of a vehicle when a door of the vehicle is closed and release the striker when the door is to be open;

a locking/unlocking member configured to switch between locking and unlocking of the door;

a first switch configured to detect a state of the locking/unlocking member corresponding to switching between the locking and the unlocking of the door;

a second switch configured to switch between on and off of a room lamp of the vehicle according to a turning position of a latch of the latch mechanism;

a connector connection portion located on an opposite side of the latch mechanism across the locking/unlocking member and configured to receive a connector for electrically connecting the vehicle door lock device to one or more devices in the vehicle; and a switch plate configured to electrically connect at least the first switch and the second switch to the connector connection portion, wherein the switch plate includes a first switch plate located on an opposite side of the latch mechanism across the locking/unlocking member and configured to electrically connect the first switch to the connector connection portion, a second switch plate located on an opposite side of the first switch plate across the locking/unlocking member and configured to electrically connect the second switch to the connector connection portion, and a switch-plate joining portion connecting the first switch plate and the second switch plate, the switch-plate joining portion extending between the first switch plate and the second switch plate, wherein the locking/unlocking member and the switch plate are housed in a case, and wherein the switch-plate joining portion of the switch plate is sandwiched between a part of the locking/unlocking member and an inner surface of the case.

2. The vehicle door lock device according to claim 1, wherein the first switch plate includes a first-switch holding portion that holds the first switch, and the second switch plate includes a second-switch holding portion that holds the second switch.

3. The vehicle door lock device according to claim 1, wherein the locking/unlocking member includes a key member that performs an action related to switching between locking and unlocking of the door according to a lock/unlock operation with a key, and the part of the locking/unlocking member used to sandwich the switch-plate joining portion is the key member so that the switch-plate joining portion of the switch plate is sandwiched between the key member and the inner surface of the case.

4. The vehicle door lock device according to claim 2, wherein the locking/unlocking member includes a key member that performs an action related to switching between locking and unlocking of the door according to a lock/unlock operation with a key, and the part of the locking/unlocking member used to sandwich the switch-plate joining portion is the key member so that the switch-plate joining portion of the switch plate is sandwiched between the key member and the inner surface of the case.

* * * * *